US005970869A

United States Patent [19]

Hara et al.

[11] Patent Number: 5,970,869

[45] Date of Patent: Oct. 26, 1999

[54] STENCIL PRINTER

[75] Inventors: Yoshikazu Hara; Hisashi Sanagi, both of Ibaraki-ken, Japan

[73] Assignee: Riso Kagaku Corporation, Tokyo, Japan

[21] Appl. No.: 09/106,837

[22] Filed: Jun. 30, 1998

[30] Foreign Application Priority Data

Jul. 2, 1997 [JP] Japan ..... 9-177180

[51] Int. Cl.[6] ..... B41L 13/06

[52] U.S. Cl. ..... 101/128.4; 101/477

[58] Field of Search ..... 101/114, 116, 101/128.4, 477, 117, 118, 121, 128.21

[56] References Cited

U.S. PATENT DOCUMENTS

| | | | |
|---|---|---|---|
| 4,966,073 | 10/1990 | Hasegawa et al. . | |
| 5,634,404 | 6/1997 | Okuda | 101/477 |
| 5,673,619 | 10/1997 | Ohinata et al. | 101/116 |
| 5,713,279 | 2/1998 | Lida et al. | 101/128.4 |

FOREIGN PATENT DOCUMENTS 0712730 5/1996 European Pat. Off. .

OTHER PUBLICATIONS

Patent Abstract of Japan, Publication No. 05004438, Jan. 14, 1990.

Patent Abstract of Japan, Publication No. 61287781, Dec. 18, 1986.

*Primary Examiner*—Ren Yan

*Attorney, Agent, or Firm*—Sixbey, Friedman, Leedom & Ferguson, P.C.; Donald R. Studebaker

[57] ABSTRACT

In a stencil printer, a first conveyor portion conveys a stencil master toward a printing drum and includes a rotatable platen roller which rotates to convey the stencil master pinched between the platen roller and a thermal head and associates with the thermal head to thermally make a perforating image on the stencil master. A second conveyor portion which is disposed between the first conveyor portion and the printing drum and conveys the stencil master toward the printing drum. When making the perforating image on the stencil master, the first conveyor portion operates at a first speed with the second conveyor portion stopped or operated at a low speed after the leading end of the stencil master is delivered to the second conveyor portion. When conveying the leading end of the stencil master, on which the perforating image has been made, toward a master clamping mechanism disposed on a generatrix of the printing drum, the second conveyor portion operates at a second speed lower than the first speed with the first conveyor section stopped.

5 Claims, 6 Drawing Sheets

STENCIL PRINTER

BACKGROUND OF THE INVENTION

1. Field of the Invention

This invention relates to a stencil printer, and more particularly to a stencil printer in which a stencil master, which is made by a stencil making section including a thermal head and the like, is wrapped around a printing drum.

2. Description of the Related Art

When thermally making a perforated image on a stencil master while rotating a platen roller in a sub-scanning direction with the stencil master pinched between the platen roller and the thermal head (TPH), the stencil master on which the perforated image has been formed is stored in a storage box utilizing the difference in speed between the conveyor portion on the inlet side of the storage box (a first conveyor portion comprising a master introduction conveyor roller and the platen roller) and the conveyor portion on the outlet side of the storage box (a second conveyor portion comprising a master discharge conveyor roller), i.e., with the conveying speed of the second conveyor portion set lower than that of the first conveyor portion or with the second conveyor portion stopped.

Further when the stencil master is conveyed in order to bring the leading end of the stencil master into engagement with the drum, the portion of the stencil master stored in the storage box is drawn out from the storage box with the second conveyor portion driven at a speed higher than the first conveyor portion, i.e., with the conveying speed of the second conveyor portion set higher than that of the first conveyor portion or with the first conveyor portion stopped, within a range in which no tension is applied to the slack portion of the stencil master.

The conveying speed of the platen roller in the first conveying portion corresponds to the conveying speed of the scanner in the image read-out section which outputs image information to the TPH to cause the TPH to record the image information on the stencil master each time the scanner reads out the image on the original along one line. Since the master introduction roller and the platen roller are driven by the same drive means, the conveying speed of the first conveyor section (the master introduction roller and the platen roller) is governed by the stencil making speed of the TPH. Conventionally the conveying speed of the second conveying portion also corresponds to the stencil making speed of the TPH and substantially the same as that of the first conveying portion though the former is sometimes lower than the latter and sometimes higher than the latter.

However the conveying speed of the second conveyor portion substantially the same as that of the first conveyor portion is too high for conveying the leading end of the stencil master to the clamp mechanism on the drum. That is, the stencil master can slip on the conveyor roller in the second conveying section and the conveyor roller cannot be immediately stopped due to inertia upon stopping the drive means of the second conveyor portion, which results in the leading end of the stencil master overshooting the predetermined position and gives rise to a problem that the leading end portion of the stencil master is curved or bent.

However when the conveying speeds of both the first and second conveyor sections are slowed down, the stencil making time is excessively elongated and convenience in use of the printer deteriorates.

SUMMARY OF THE INVENTION

In view of the foregoing observations and description, the primary object of the present invention is to provide a stencil printer in which the leading end of the stencil master can be accurately positioned in a desired position relative to the clamp means on the drum.

In accordance with the present invention, there is provided a stencil printer comprising

- a first conveyor portion which conveys a stencil master toward a printing drum and includes a rotatable platen roller which rotates to convey the stencil master pinched between the platen roller and a thermal head and associates with the thermal head to thermally make a perforated image on the stencil master
- a second conveyor portion which is disposed between the first conveyor portion and the printing drum and conveys the stencil master toward the printing drum, and
- a conveyance drive means which, when making the perforated image on the stencil master, causes the first conveyor portion to operate at a first speed with the second conveyor portion stopped or operated at a low speed after the leading end of the stencil master is delivered to the second conveyor portion, and when conveying the leading end of the stencil master, on which the perforating image has been made, toward a master clamping means disposed on a generatrix of the printing drum, causes the second conveyor portion at a second speed lower than the first speed with the first conveyor section stopped.

In one embodiment of the present invention, the second conveyor portion is driven by an electric motor which is rotated upon input of a pulse and the conveyance drive means selectively inputs low speed clocks or high speed clocks to the motor.

In the stencil printer in accordance with the present invention, the first conveyor section conveys the stencil master while the thermal head thermally makes a perforated image on the stencil master. The first conveyor portion conveys the stencil master at a first speed, which is high, during the stencil making and is stopped when the master is mounted on the printing drum.

The second conveyor portion is disposed between the first conveyor portion and the printing drum and conveys the stencil master having a perforated image toward the printing drum. The second conveyor portion conveys the stencil master to a predetermined position at the first speed and is stopped when the perforated image is made, and when mounting the stencil master on the printing drum, the second conveyor section conveys the stencil master at the second speed lower than the first speed.

Thus, since the stencil master is conveyed at a high speed during the stencil making operation and at a low speed during mounting the stencil master, the leading end of the stencil master can be accurately positioned relative to the clamp means on the drum without substantially elongating the overall time.

DESCRIPTION OF THE PREFERRED EMBODIMENT

Figure 1:
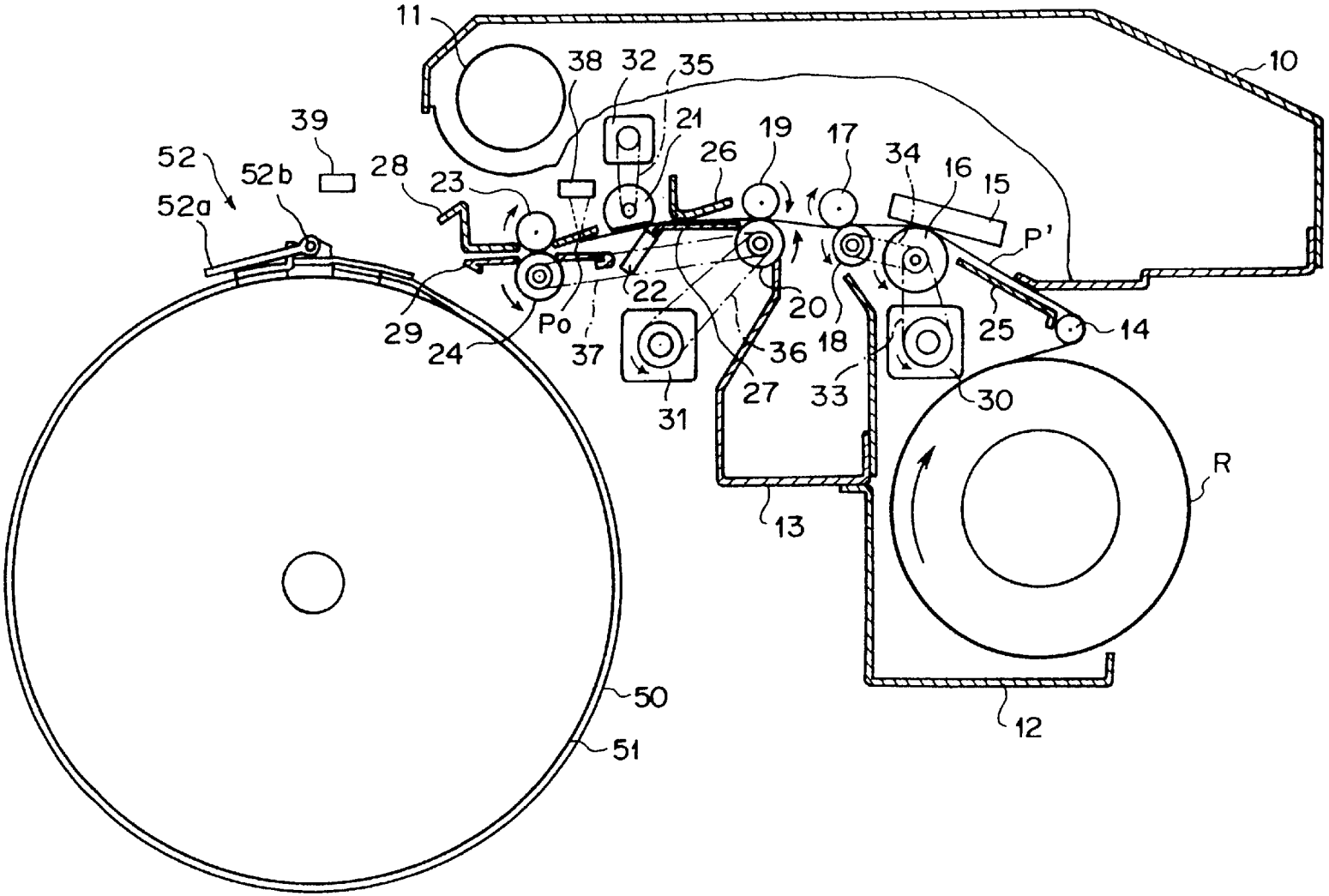
FIG. 1 is a side view of a stencil printer in accordance with an embodiment of the present invention.

FIG. 1 shows a stencil printer in accordance with an embodiment of the present invention. The arrangement related to making the stencil master and mounting the stencil master on the printing drum described, below.

In FIG. 1, a pressure plate 10 can be opened and closed about a pivot shaft 11 supported on a printer body. A roll R of a stencil master P' in a continuous length is stored in a roll box 12.

The stencil master P' is conveyed along a path of conveyance and a perforated image is formed on the stencil master P' in a master making section and the stencil master P thus formed is wrapped around a printing drum 50.

Description will be made along the path of conveyance. The stencil master P' is passed between a thermal head 15 and a platen roller 16 under the guidance of a guide plate 25 and a fixed shaft 14.

The thermal head 15 thermally forms a pattern of perforations on the stencil master P' according to image data from an image read-out section.

The platen roller 16 conveys the stencil master P' in the sub-scanning direction of the thermal head 15 at a predetermined speed. The platen roller 16 is rotated by a write motor 30 connected to the platen roller 16 by a belt 33.

A first interlocking roller 17 is supported for rotation on the pressure plate 10 and is in contact with a first conveyor roller 18 under its weight. The first conveyor roller 18 is rotated by the write motor 30 by way of belts 33 and 34.

A second interlocking roller 19 is supported for rotation on the pressure plate 10 and is in contact with a second conveyor roller 20 under its weight. The second conveyor roller 20 is rotated by a master mounting motor 31 by way of a belt 36.

A storage box 13 is provided between the first and second conveyor rollers 18 and 20. The stencil master P' is stored in the storage box 13 during a master making process.

The stencil master P' is guided by guide plates 26 and 27 into a cutter section, which comprises a fixed edge 22 and a movable edge 21 rotated by a cutter motor 32 by way of a belt 35 and cuts the stencil master P' by driving the cutter motor 32.

A master waiting position sensor 38 is a reflective optical sensor which detects the leading end of the stencil master P.

Master guide plates 28 and 29 guide the stencil master P toward the printing drum 50.

A third interlocking roller 23 is supported for rotation on the pressure plate 10 and is in contact with a third conveyor roller 24 under its weight. The third conveyor roller 24 is rotated by the master mounting motor 31 by way of belts 36 and 37.

Each of the second and third conveyor rollers 20 and 24 is provided with a built-in one-way clutch. When mounting the stencil master P on the drum 50, the second and third conveyor rollers 20 and 24 are rotated in free-running in response to rotation of the drum 50 to feed out the stencil master P though the master mounting motor 31 is stopped.

The platen roller 16, the first interlocking roller 17, the first conveyor roller 18, the guide plate 25, the write motor 33 and belts 33 and 34 form a first conveyor portion.

The first conveyor portion conveys the stencil master P' mainly for making perforations in a stencil master P and feeds the stencil master P' into the storage box 13.

The second interlocking motor 19, the second conveyor roller 20, the third interlocking roller 23, the third conveyor roller 24, the guide plates 26, 27, 28 and 29, the master mounting motor 31, the belts 36 and 37, the master waiting position sensor 38 and a mounting position sensor 39 form a second conveyor portion.

The second conveyor portion draws the stencil master P' out of the storage box 13 and mounts the stencil master P on the drum 50.

The mounting position sensor 39 is for detecting the leading end of the stencil master P on the drum 50 and detects arrival of the leading end of the stencil master P at a clamp mechanism 52 on the drum 50.

The write motor 30 and the master mounting motor 31 are stepping motors and are controlled by a conveyance drive means (not shown) to rotate a predetermined number of revolutions. The motor driving circuit is supplied with clock pulses from a high speed clock circuit and a low speed clock circuit.

The clock pulses of the low speed clock circuit are set to cause a rotation of a motor at a speed at least lower than that at which the motor is rotated by the clock pulses of the high speed clock circuit.

The conveyance drive means supplies to the write motor 30 high speed clock pulses from the high speed clock circuit.

To the master mounting motor 31, the conveyance drive means selectively supplies high speed clock pulses from the high speed clock circuit and low speed clock pulses from the low speed clock circuit depending on the period of conveyance as will be described later.

Thus the first conveyor portion conveys the stencil master P' at a first speed which is relatively high, and the second conveyor portion conveys the stencil master P' selectively at a first speed which is relatively high and at a second speed which is lower than the first speed depending on the period of conveyance.

The stencil master conveyed by the first and second conveyor portions is fed out through the guide plates 28 and 29 in a tangential direction of the drum 50.

A screen 51 is wrapped around the circumferential surface of the drum 50 and ink supplied from an ink supply means (not shown) disposed inside the drum 50 passes through the screen 51.

The clamp mechanism 52 is provided on the drum 50 along a generatrix of the drum 50. The clamp mechanism 52 comprises a clamp plate **52*a* which is rotatable about a clamp shaft 52*b*** between an open position and a closed position.

The clamp mechanism 52 holds thereon the leading end portion of the stencil master P fed out from the second conveyor portion by closing the clamp plate **52*a* and releases the stencil master P after printing by opening the clamp plate 52*a***.

The drum 50 is rotated during printing and a printing paper sheet is passed between the drum 51 and a pressure roller (not shown) opposed to the drum 50, during which ink passing through the stencil master P is transferred to the printing paper sheet and the image on the stencil master P is printed on the printing paper sheet.

The stencil printer with the arrangement described above is controlled by a control section (not shown). The control section comprises a microcomputer provided with a CPU, a ROM, a RAM and the like. The microcomputer executes various controls on the basis of control program stored in the ROM and the like.

The content of the control includes making a stencil master, mounting and discharge of the master, supply and discharge of the printing paper sheets and rotation of the drum and the microcomputer causes the stencil printer to make a designated number of prints according to setting through a control panel.

Figure 6:
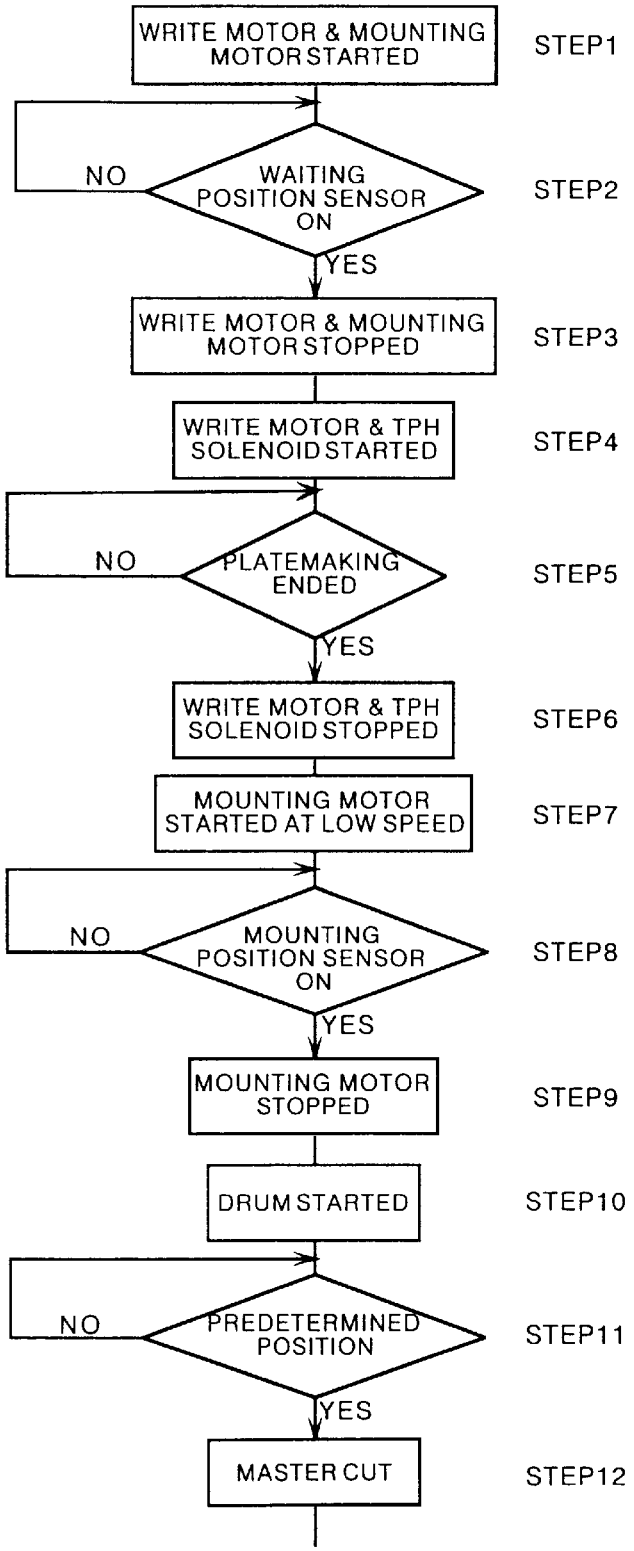
FIG. 6 is a flow chart for illustrating the control executed by the control section of the stencil printer.

The operation of making the stencil master P and mounting the stencil master P on the drum 50 will be described with reference to the flow chart shown in FIG. 6. The functions of the flow chart are executed by the control section.

FIG. 1 shows a state during positioning of the stencil master P' as a stage prior to making a stencil master P. After a preceding stencil master P is cut by the movable edge 21 and the fixed edge 22 (step 12), the write motor 30 and the master mounting motor 31 are driven until the leading end P0 of the stencil master P' is detected by the master waiting position sensor 38 (step 2: YES).

During positioning of the stencil master P', clock pulses from the high speed clock circuit are supplied to the write motor 30, whereby the write motor 30 causes the stencil master P' to be conveyed at the first speed, and at the same time, conveyance drive means causes the high speed clock circuit to supply clocks to the master mounting motor 31, whereby the master mounting motor 31 causes the stencil master P' to be conveyed at the first speed.

Accordingly, the platen roller 16, the first interlocking roller 17, the first conveyor roller 18, the second interlocking roller 19, the second conveyor roller 20, the third interlocking roller 23 and the third conveyor roller 24 convey the stencil master P' at the first speed which is high.

When the leading end P0 of the stencil master P' reaches the master waiting position sensor 38, the write motor 30 and the master mounting motor 31 are stopped (step 3).

In place of detecting the leading end P0 of the stencil master P' by use of the master waiting position sensor 38, it is possible to supply the write motor 30 and the master mounting motor 31 with pulses in a number which is required to convey leading end P0 of the stencil master P' to the position of the sensor 38.

Figure 2:
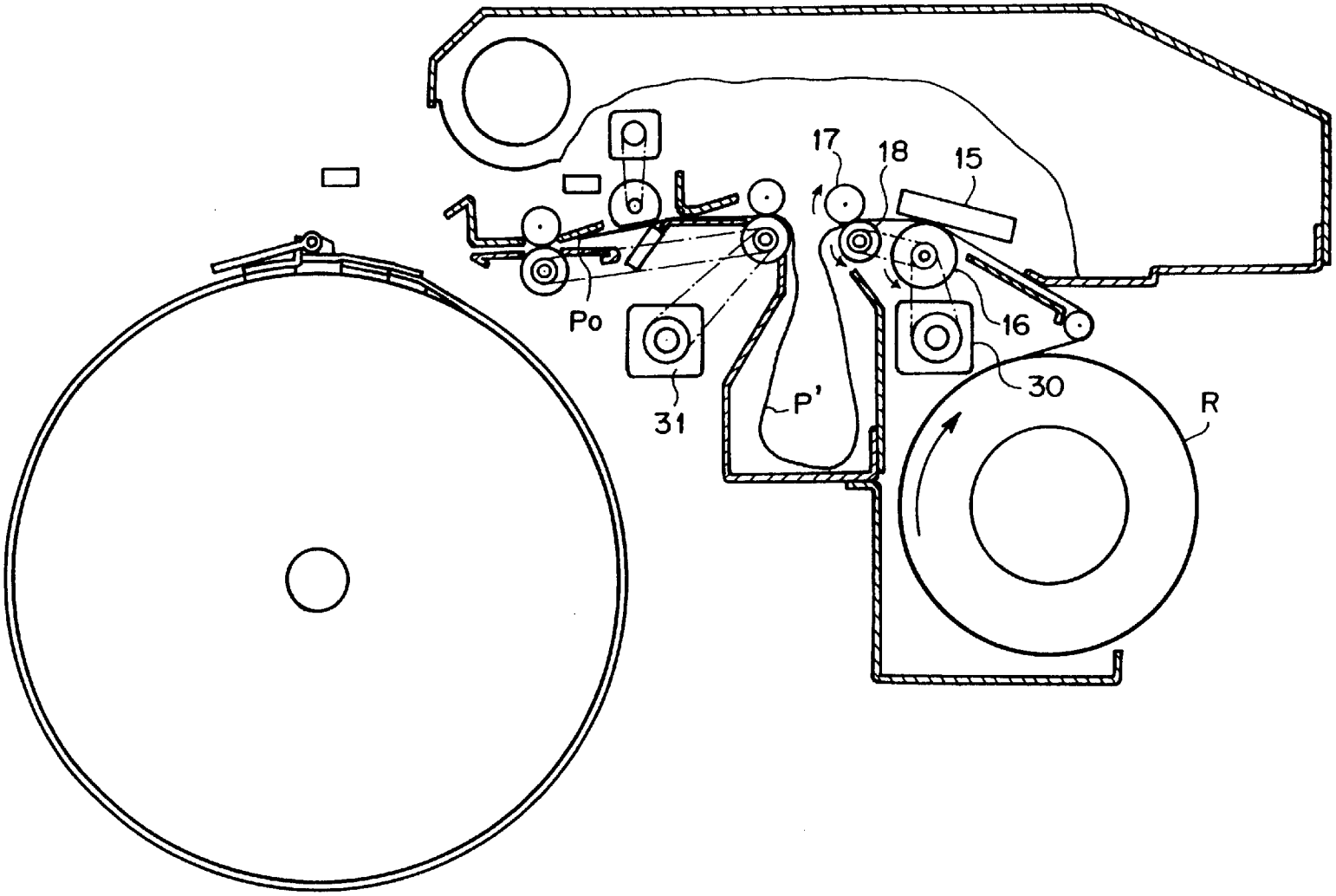
FIGS. 2 to 5 are side views for illustrating the operation of the stencil printer.

FIG. 2 shows a state during making a perforating image on the stencil master P'.

Upon receipt of a signal generated in response to depression of a master making start key on the control panel, the control section starts the write motor 30 and a TPH solenoid (not shown), thereby thermally making a perforated image on the stencil master P' (step 4).

At this time, the master mounting motor 31 is stopped or operated at a low speen, and only the write motor 30 is driven at the first speed, whereby the stencil master P' is conveyed into the storage box 13. The portion of the stencil master P' corresponding to the trailing end of the stencil master P to be subsequently cut off is in the storage box 13.

When energized, the TPH solenoid presses the thermal head 15 against the platen roller 16 at a predetermined pressure. When the TPH solenoid is not energized, the thermal head 15 is in contact with the platen roller 16 under its weight.

Timer interruption is carried out on the CPU in the control section and a time required to making the perforated image (e.g., 17.3 seconds) is counted down. When the count becomes 0, stencil making is ended and the write motor 30 and the TPH solenoid are de-energized (step 5).

Instead, the write motor 30 may be supplied with pulses in a number corresponding to the time required to making the perforating image.

The first to third interlocking rollers 17, 19 and 23 are supported for rotation on the pressure plate 10 and are in contact with the first to third conveyor rollers 18, 20 and 24 under their weight to be rotated freely.

Figure 3:
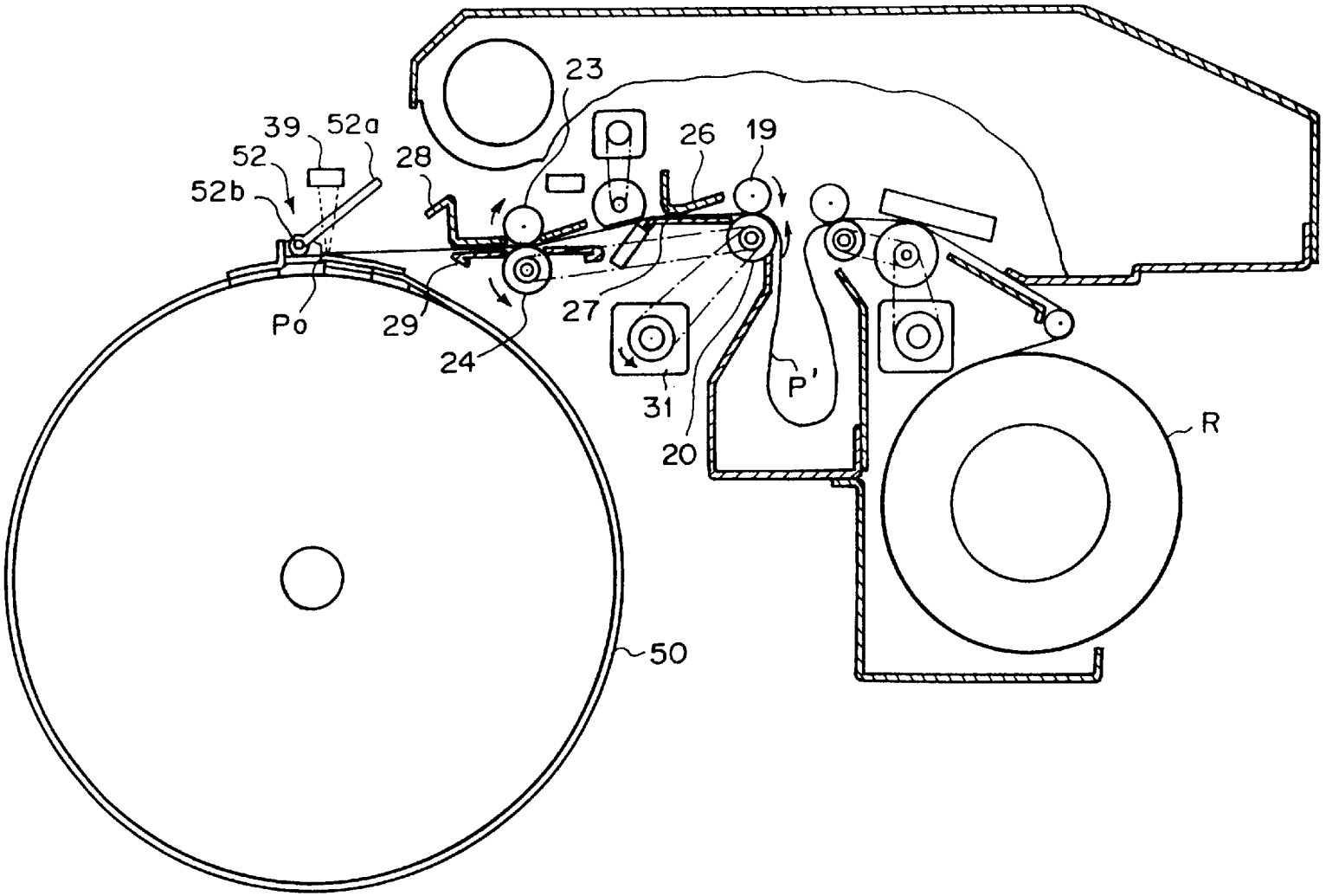

FIG. 3 shows conveyance of the stencil master P' for mounting the stencil master P With the write motor 30 and the TPH solenoid stopped, the conveyance drive system causes the low speed clock circuit to supply low speed clock pulses to the master mounting motor 31 (step 7).

The master mounting motor 31 feeds the stencil master P' toward the drum 50 at the second speed which is low, and the portion of the stencil master P' in the storage box 13 is drawn out.

When the mounting position sensor 39 detects the leading end P0 of the stencil master P on the leading end portion of the stencil master P' (step 8: YES), the master mounting motor 31 is stopped. At this time, since the stencil master P' has been conveyed at a low speed (the second speed), the stencil master P' can be stopped immediately after detection of the leading end P0 by the mounting position sensor 39, whereby the leading end can be accurately positioned in place.

At this time, the clamp plate 52*a* of the clamp mechanism 52 on the drum 50 has been half opened by a drive means (not shown) as shown in FIG. 3.

In place of detecting the leading end P0 of the stencil master P' by use of the mounting position sensor 39, it is possible to supply the master mounting motor 31 with pulses in a number which is required to convey the leading end P0 of the stencil master P' to the position of the sensor 39 (a predetermined position relative to the clamp mechanism) 52.

Figure 4:
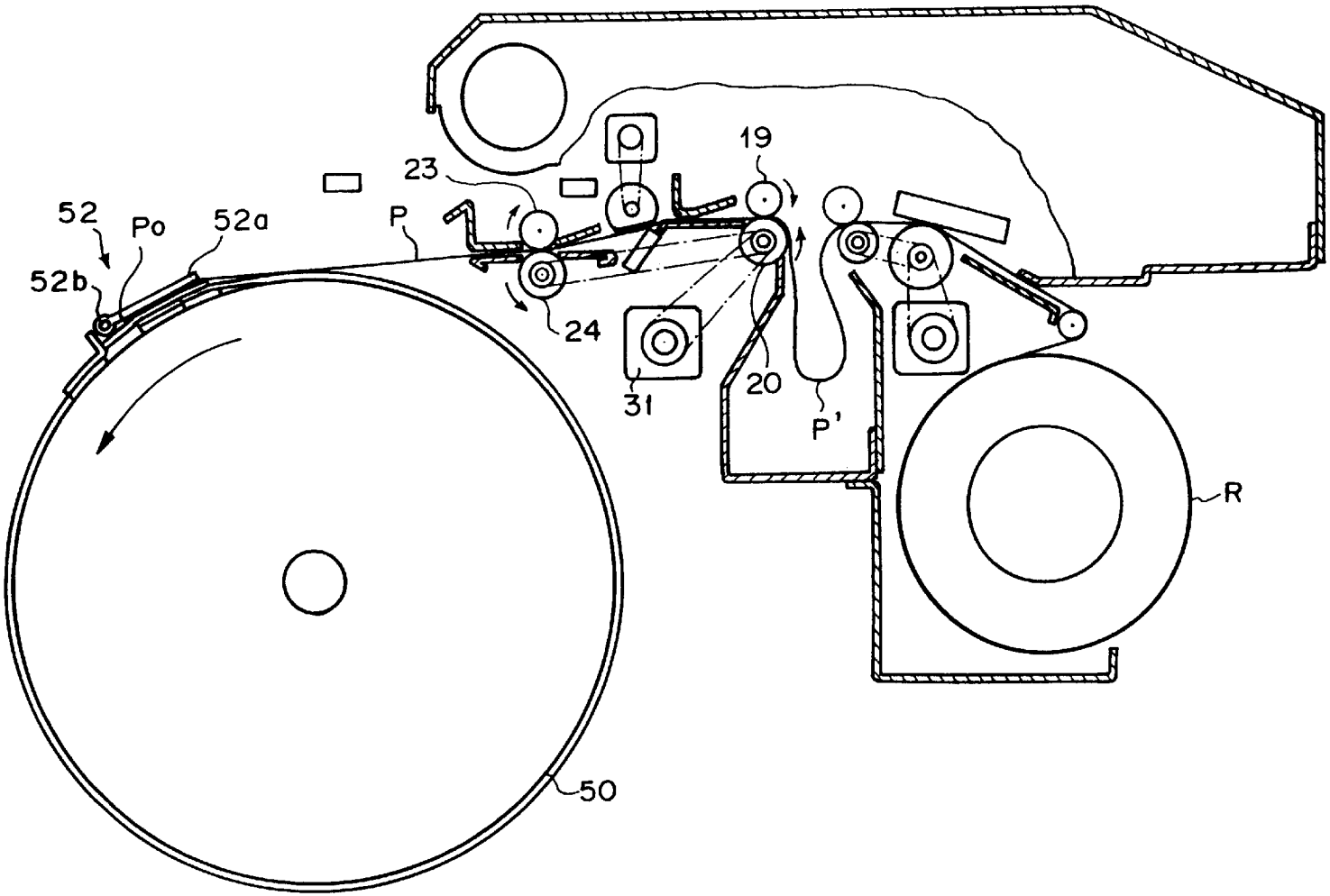

FIG. 4 shows wrapping of the stencil master P around the drum 50.

Then the clamp plate 52*a* is rotated to the closed position to pinch the leading end P0 of the stencil master P and then the drum 50 is rotated so that the stencil master P is wrapped around the drum 50 (step 10).

At this time the write motor 30 and the master mounting motor 31 are stopped and the second and third conveyor rollers 20 and 24 are rotated freely by virtue of the one-way clutch built therein in response to conveyance of the stencil master P' by rotation of the drum 50. With this arrangement, an excessive tension cannot be applied to the stencil master P and the stencil master P is prevented from being wrinkled.

Figure 5:
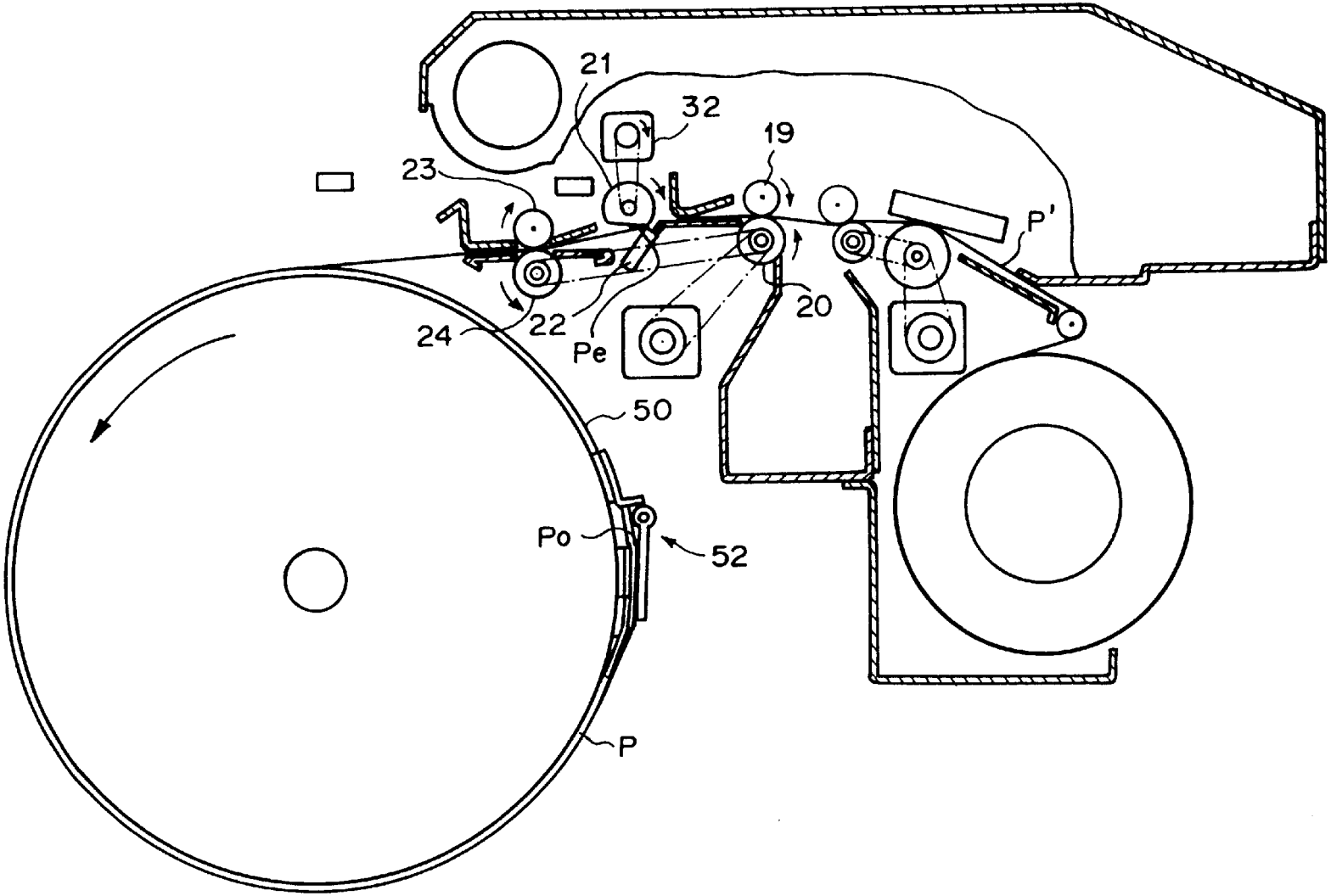

FIG. 5 shows cutting of the stencil master P off the stencil master P'.

When the drum 50 is rotated through a predetermined angle (step 11), the trailing end Pe of the stencil master P is cut.

The angle of rotation of the drum 50 is detected by a rotating angle detecting means (not shown). For example, the angle of rotation of the drum 50 can be detected by providing an encoder on the drive shaft of the main motor (a DC motor) for driving the drum 50 and counting the number of output pulses or by providing a detecting plate in a predetermined position on the flange of the circumferential surface of the drum 50 and detecting the detecting plate by an optical sensor fixed outside the drum 50.

In this manner, the stencil master P is gradually wrapped around the drum 50 as the drum 50 rotates and when the drum 50 comes to an angular position where the mounting of the stencil master P is to be ended, the cutter motor 32 is driven to rotate the movable edge 21 and the movable edge 21 cuts the trailing end Pe of the stencil master P associated with the fixed edge 22.

In the manner described above, a stencil master P for one printing is made and mounted on the drum 50.

Thereafter the drum 50 bearing thereon the stencil master P is rotated while a plurality of printing paper sheets are continuously fed to the drum 50, whereby an image corresponding to the image on the stencil master P is printed on each printing paper sheet.

As can be understood from the description above, in the stencil printer in accordance with the present invention, when the leading end of the stencil master P' is conveyed toward the clamp position, the second conveyor portion is driven at a speed lower than that of the first conveyor portion with the first conveyor portion stopped, and accordingly, the leading end of the stencil master P' can be accurately stopped in a desired position. Further since the stencil master P' is conveyed at a high speed during making a perforating image on the stencil master P', the time between perforating image and mounting of the made stencil master need not be unnecessarily long.

What is claimed is:

1. A stencil printer comprising a first conveyor portion which conveys a stencil master toward a printing drum and includes a rotatable platen roller which rotates to convey the stencil master pinched between the platen roller and a thermal head to thermally make a perforated image on the stencil master, a second conveyor portion which is disposed between the first conveyor portion and the printing drum and conveys the stencil master toward the printing drum, and a conveyance drive means which, when perforating the stencil master, causes the first conveyor portion to operate at a first speed with the second conveyor portion stopped or operated at a low speed after the leading end of the stencil master is delivered to the second conveyor portion, and when conveying the leading end of the stencil master, on which the perforated image has been made, toward a master clamping means disposed on the printing drum, causes the second conveyor portion to operate at a second speed lower than the first speed with the first conveyor portion stopped.

2. A stencil printer as defined in claim 1 in which the second conveyor portion is driven by an electric motor which is rotated upon input of a pulse and the conveyance drive means selectively inputs low speed pulses or high speed pulses into the motor.

3. A stencil printer as defined in claim 1, wherein the conveyance drive means causes the first conveyor portion and the second conveyor portion to operate at the first speed during positioning of the stencil master between the platen roller and the thermal head.

4. A stencil printer comprising a first conveyor portion which conveys a stencil master toward a thermal head to make a perforated image on the stencil master, a second conveyor portion which is disposed between the first conveyor portion and a printing drum and conveys the stencil master toward the printing drum, and a conveyance drive means which, when perforating the stencil master, causes the first conveyor portion to operate at a first speed with the second conveyor portion stopped or operated at a low speed after the leading end of the stencil master is delivered to the second conveyor portion, and when conveying the leading end of the stencil master, on which the perforated image has been made, toward a clamping means associated with the printing drum, causes the second conveyor portion to operate at a second speed lower than the first speed.

5. A stencil printer as defined in claim 4, wherein the conveyance drive means causes the first conveyor portion and the second conveyor portion to operate at the first speed during positioning of the stencil master opposite the thermal head.

* * * * *